US007597453B2

(12) United States Patent
Simon

(10) Patent No.: US 7,597,453 B2
(45) Date of Patent: Oct. 6, 2009

(54) LUMINAIRES USING MULTIPLE QUASI-POINT SOURCES FOR UNIFIED RADIALLY DISTRIBUTED ILLUMINATION

(76) Inventor: Jerome H. Simon, 70 Sumner St., Newton Centre, MA (US) 02459

( * ) Notice: Subject to any disclaimer, the term of this patent is extended or adjusted under 35 U.S.C. 154(b) by 0 days.

(21) Appl. No.: 11/583,441

(22) Filed: Oct. 19, 2006

(65) Prior Publication Data

US 2008/0030987 A1 Feb. 7, 2008

Related U.S. Application Data

(63) Continuation-in-part of application No. 11/034,395, filed on Jan. 12, 2005.

(60) Provisional application No. 60/728,343, filed on Oct. 19, 2005, provisional application No. 60/536,477, filed on Jan. 14, 2004.

(51) Int. Cl.

| | |
|---|---|
| ***F21V 1/00*** | (2006.01) |
| ***F21V 11/00*** | (2006.01) |
| ***F21V 5/00*** | (2006.01) |
| ***F21V 21/00*** | (2006.01) |

(52) U.S. Cl. ..... 362/237; 362/241; 362/243; 362/245; 362/249.02; 362/327

(58) Field of Classification Search ..... 362/268, 362/331, 335, 219, 227, 234–247, 249.02, 362/327–329

See application file for complete search history.

(56) References Cited

U.S. PATENT DOCUMENTS

| | | | | |
|---|---|---|---|---|
| 4,954,936 | A * | 9/1990 | Kawabata et al. | 362/249 |
| 5,642,933 | A * | 7/1997 | Hitora | 362/243 |
| 5,769,532 | A * | 6/1998 | Sasaki | 362/237 |
| 5,897,201 | A * | 4/1999 | Simon | 362/268 |
| 6,135,612 | A * | 10/2000 | Clore | 362/184 |
| 6,361,191 | B1 * | 3/2002 | Simon | 362/328 |
| 6,616,305 | B1 * | 9/2003 | Simon | 362/309 |
| 6,905,228 | B1 * | 6/2005 | Takeyasu et al. | 362/237 |
| 2004/0036014 | A1 * | 2/2004 | Simon | 250/216 |
| 2005/0047135 | A1 * | 3/2005 | Rhoads et al. | 362/240 |
| 2005/0083699 | A1 * | 4/2005 | Rhoads et al. | 362/296 |
| 2006/0044814 | A1 * | 3/2006 | Ikeda | 362/382 |

* cited by examiner

*Primary Examiner*—Jong-Suk (James) Lee
*Assistant Examiner*—David J Makiya
(74) *Attorney, Agent, or Firm*—Burns & Levinson LLP; Harvey Kaye; David Gomes

(57) ABSTRACT

A luminaire for providing broad uniform surface illumination and sharp cutoff which has at least one quasi point light source, such as an LED, located on an optical axis. There is at least one collimating ring lens which, at least partially surrounds the quasi point light source. The collimating ring projects a radial collimated beam and there is at least one reflective ring, at least partially surrounding the collimating ring lens. The reflecting ring reflects and redirects the collimated radial beam as a canted radial beam through the optical axis. In another embodiment at least one off axis collimating ring lens at least partially surrounds at least one quasi point light source, and projects a canted radial beam away from the optical axis. There is at least one ring reflector which at least partially surrounds the optical axis and is positioned to reflect the canted radial beam toward and through the optical axis. In a further embodiment, at least one linearly collecting reflector at least partially surrounds the quasi point light source and the reflector projects a linear beam onto a substantially conical reflector which redirects the linear beam into a radially directed beam.

22 Claims, 8 Drawing Sheets

CRC
ORD
LED
BR

RB1
TS
AX
RB
ORD
WRP

RBA
ORD1
RB1
EQ
CA1
ORD2
CA2
EQ
RB2
ORD3
CA3
RB3

ORD1
NQ
DV
ORD2
NQ

ORD 3
AX
CRC
LED
ORR
RR

ORR1
RR1
CRS1
ORR2
RR2
CRS2
FR
FR
ORD 1
A1
RB1
WRP1
RA1
BA1
A2
WRP2
RA2
BA2
ORD2
ORD3
WRP3
RA3
A3
BA 3

LUMINAIRES USING MULTIPLE QUASI-POINT SOURCES FOR UNIFIED RADIALLY DISTRIBUTED ILLUMINATION

REFERENCE TO RELATED APPLICATIONS

The present application is based on and claims the priority of provisional application, Ser. No. 60/728,343 filed Oct. 19, 2005. The substance of that application is hereby incorporated herein by reference.

The present application is a continuation-in-part of application Ser. No. 11/034,395 filed Jan. 12, 2005. The priority of that application is claimed and the substance of that application is hereby incorporated herein by reference. Application Ser. No. 11/034,395 claims the benefit of provisional application 60/536,477 filed Jan. 14, 2004 and the priority of that application is claims and the substance of that application is hereby incorporated herein by reference.

FIELD OF INVENTION

The present invention relates generally to the lighting field, and, more particularly to providing homogenized light from multiple light sources.

SUMMARY OF INVENTION

The present invention provides uniform surface illumination from a luminaire containing multiple light sources and homogenized light from multiple light sources.

The present invention further provides sharp cutoff at any desired angle from a luminaire containing multiple light sources.

Also, the present invention provides mixed color from different colored light sources.

Further, the present invention provides broad evenly distributed illumination from a luminaire containing multiple light sources.

BRIEF DESCRIPTION OF THE DRAWINGS

These and other objects, features and advantages will be apparent from the following detailed description of preferred embodiments taken in conjunction with the accompanying drawings in which:

FIG. 1*c* is a cross-sectional diagram similar to FIG. 1*b* further comprising refracting rings.

DETAILED DESCRIPTION OF PREFERRED EMBODIMENTS

Figure 1:
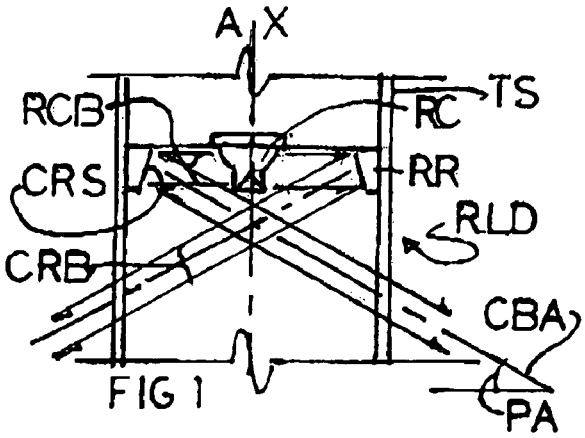
FIG. 1 is a cross-sectional diagram of the optical components of a luminaire comprised of a single quasi point light surrounded by a collimating lens and a ring reflector for projecting broadly distributed illumination.

FIG. 1 is a cross-sectional diagram illustrating a single radial light distribution module containing a quasi-point light source such as an LED within a radially collimating ring optic RC, further surrounded by a reflective ring RR having a conically reflecting surface CRS. RC projects a radial collimating beam RCB onto the substantially specular conical surface CRS of RR which in turn reflects canted radial beam CRB1 which has a projected beam angle PA. PA is substantially focused on and passes through the axis AX of RC. The function of RLD is similarly discussed in my co-Pending patent application Ser. No. 11/034,395. RLD is supported within an optically transmissive tube TS.

Figure 1A:
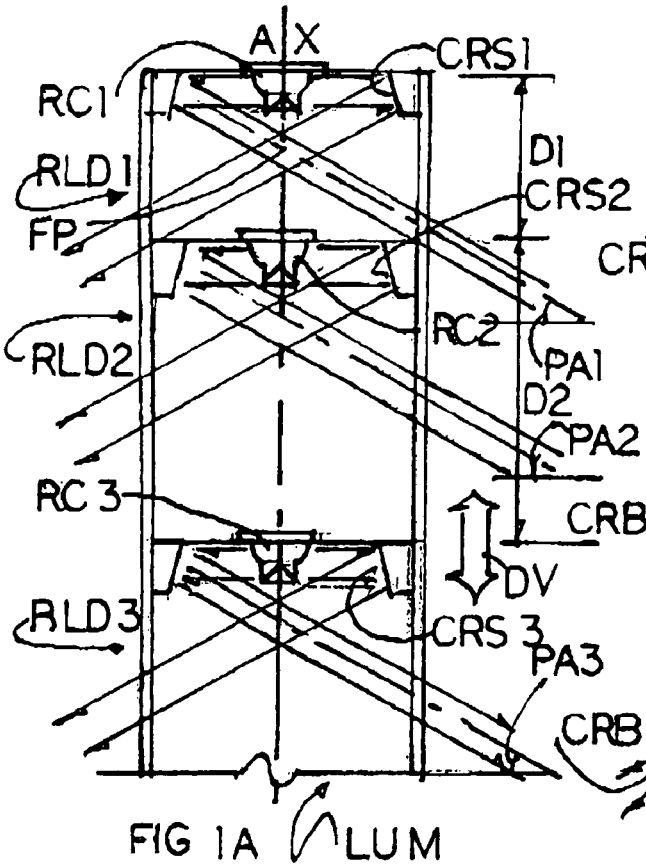
FIG. 1*a* is a cross-sectional diagram of the optical components of a luminaire comprised of multiple quasi point light sources, each surrounded by collimating ring lenses and a ring reflector.

FIG. 1A is a cross-sectional diagram of a luminaire LUM illustrating multiple RLD modules (shown in FIG. 1) RLD1, RLD2, and RLD3, all having similar radially collimating ring optics RC1, RC2, and RC3 respectively, as well as similar reflective ring surfaces CRS1, CRS2, and CRS3 respectively; therefore, the projected respected beam angles PA1, PA2, and PA3 are substantially equal. FIG. 1A further illustrates that the distance between RLD2 and RLD3 can be the same or different, varying in distance by shifting RLD1, RLD2, and RLD3 in relationship to each other along axis AX as illustrated by graphic arrow DV. Although FIG. 1A illustrates three RLDs, any number of RLDs may be employed along AX at equal and or varying distances from each other.

Figure 1B:
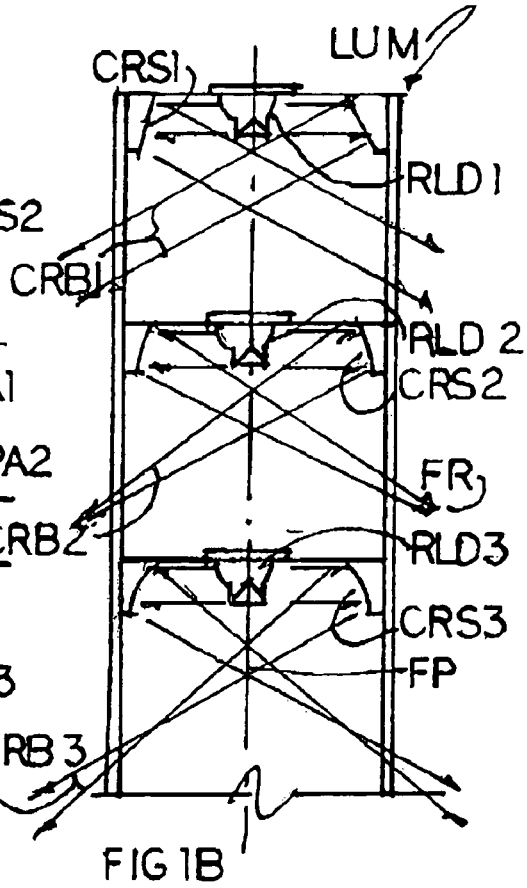
FIG. 1*b* is a cross-sectional diagram similar to FIG. 1*a* wherein the ring reflectors are curved in section.

FIG. 1B is a cross-sectional diagram similar to that of FIG. 1A, illustrating RLD1, RLD2, and RLD3, each having differing cross-section curvatures of the reflecting ring's surfaced CRS1, being substantially flat (as in FIG. 1), CRS2 having a shallow concave surface (round, parabolic, or ellipsoidal), than CRS3. CRS1 reflects radial beam RB1 as canted beam CRB1, the cross-sectional divergence of which is substantially equal to RB1. CRS2 reflects RB2 as convergent, then divergent (in section) CRB2. CRS3 reflects RB3 as beam CRB3, which is more rapidly converging and then diverging than CRB2 due to the greater optical power of CRS3 than CRS2. The spacing and number of RLDs can vary as described in FIG. 1A due to the greater optical power of CRS3 than CRS2. The spacing and number of RLDs can vary as described in FIG. 1A.

FIG. 1C is a cross-sectional diagram illustration of a grouping of RLD modules as shown in FIG. 1A, with the addition of wedge prism rings RWP1 and RWP2, which are substantially concentric and share the same optical axis as RR1. Reflector rings RR2 and RR3 respectively and wedge prism rings RWP1 and RWP2 have the function of altering the radial beam pitch angle PA2 and PA3, as illustrated as RA2 and RA3. Angle A (AA) represents the cross-sectional angle between the faces of the wedge prism ring (PWR). The greater the angle, the greater the deviation in beam direction; the approximate function of a wedge prism is, for each degree of angle difference, the beam deviation equals one-half degree. Further, the wedge prism function is to bend the beam in the direction of the wider part of the prism.

Figure 1D:
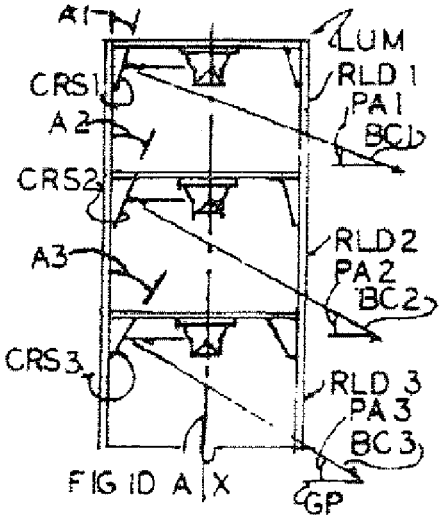
FIG. 1*d* is a cross-sectional diagram similar to FIG. 1*b* wherein the ring reflectors are canted at different angles in section.

FIG. 1D is a cross-sectional diagram of a partial luminaire LUM comprised of three RLD modules RLD1, RLD2, and RLD3 similar to those illustrated in FIG. 1. Although each of the reflective surfaces CRS1, CRS2, and CRS3 has a different respective cant angle A1, A2, and A3, A1 is most acute; therefore the angle PA1 (formed by the reflected beam angle BC1, and GP, a plane perpendicular to AX) is most acute. Cant angle A2 or CRS2 is less acute than A1 and therefore PA2 is less acute than PA1. It follows that if A3 is less acute than A2, then PA2 is less acute than PA2.

Figure 2C:
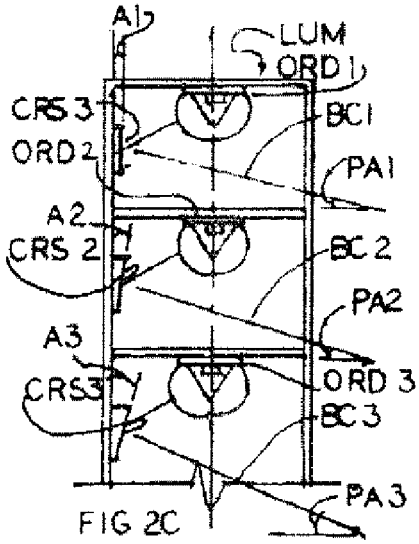
FIG. 2C is a cross-sectional view of a partial luminaire similar to FIG. 2.
Figures 2, 2A, 2B, 3, 3A, 4, 4A:
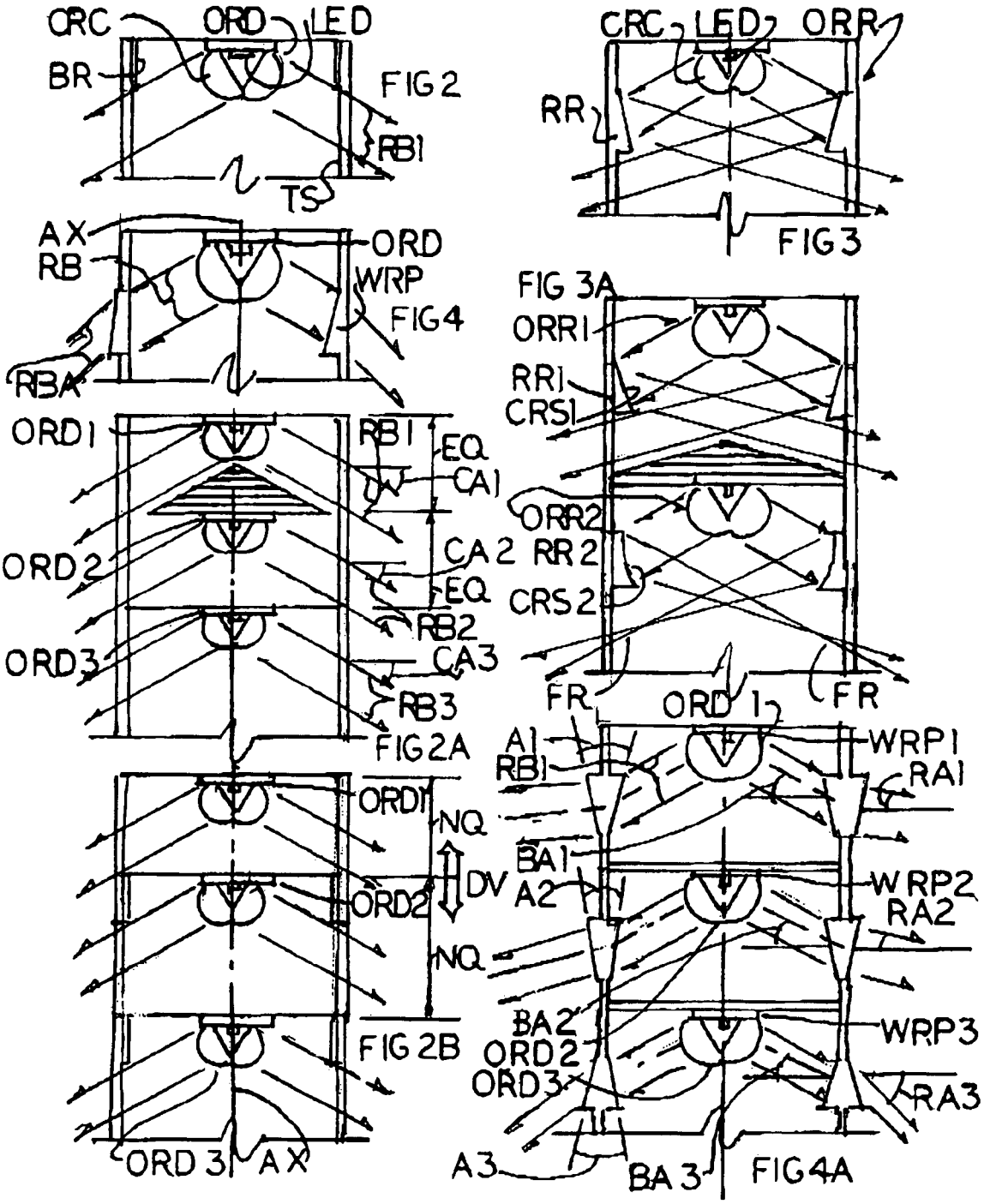
FIG. 2 is a cross-sectional diagram of an off axis radial beam collimator comprised of a quasi point light source surrounded by off axis ring collimator.
FIG. 2*a* is a cross-sectional diagram similar to FIG. 2 comprising multiple quasi point light sources each surrounded by an off axis ring collimator and further comprised of heat sinks.
FIG. 2*b* is a cross-sectional diagram similar to FIG. 2*a* wherein the quasi point light sources are located at differing distances from each other.
FIG. 3 is a cross-sectional diagram similar to FIG. 2 wherein the off axis collimating ring lens is further surrounded by a ring reflector.
FIG. 3*a* is a cross-sectional diagram similar to FIG. 2*a* wherein the off axis collimating ring lenses are further surrounded by ring reflectors.
FIG. 4 is a cross-sectional diagram similar to FIG. 2*a* wherein the off axis collimating ring lenses are further surrounded by refracting rings which in section function as wedge prisms.
FIG. 4*a* is a cross-sectional diagram similar to FIG. 4 wherein the angles of wedge prisms are different in each prism ring.

FIG. 2 is a cross-sectional diagram of an off-axis radial beam projector comprised of a quasi-point light source at least partially surrounded by an off-axis ring collimator CRC, projecting canted radial beam RB1 through a clear tubular support TS which is not essential for the light distribution provided by off-axis radial distributor ORD. Baffle ring BR blocks visual brightness emanating from CRC providing full cutoff of light that is not projected from the lens. The function of ORD is further elaborated and described in my co-pending application Ser. No. 11/034,395.

FIG. 2A is a cross-sectional diagram of an off-axis radial beam projector comprised of multiple ORDs, ORD1, ORD2, and ORD3, each projecting radial beams RB1, RB2, and RB3 respectively, each having substantially equal cant angles CA1, CA2, and CA3 respectively. The distance between ORD1 and ORD2, and the distance between ORD2 and ORD3, is equal. HST is a typical heat sing shown attached to LED of ORD2, shaped as a cone so as not to obstruct RB1.

FIG. 2B is a cross-sectional diagram of a device similar to that shown in FIG. 2A, differing in that the distance between ORD1 and ORD2 and the distance between ORD2 and ORD3 can be equal or be different by shifting one ORD in relation to another along axis AX.

FIG. 2C is a cross-sectional diagram of a partial luminaire LUM, comprised of ORD modules ORD1, ORD2, and ORD3, similar to those shown in FIG. 2. The relationship between the cant angles A1, A2, and A3 of CRS1, CRS2, and CRS3 respectively to the relationship of PA1, PA2, and PA3 is described and elaborated on in FIG. 1D.

FIG. 3 is a cross-sectional diagram of an off-axis radial beam projector similar to the one illustrated in FIG. 2 with the addition of reflector ring RR, the function and description of which is elaborated upon in FIG. 1.

FIG. 3A illustrates a radial beam projector containing two ORR modules ORR1 and ORR2 as described in FIG. 3. The cross-sectional surfaces of RR1 and RR2, CRS1 and CRS2 function and differ from each other in substantially the same way as CRS1 and CRS2 of FIG. 1A.

FIG. 4 is a cross-sectional diagram illustrating an ORD module similar to that shown in FIG. 2 with the addition of wedge prism ring WPR, which alters the cross-sectional direction of radial beam RB as radial beam RBA.

FIG. 4A is a cross-sectional diagram of a grouping of ORD modules, ORD1, ORD2, and ORD3, projecting RB1, RB2, and RB3 (all canted at the same angles) onto and through surrounding wedge prism rings WRP1, WRP2, and WRP3 respectively. Angle A1 of WRP1 is greater that A3 of WRP2 and therefore the variation between the sectional beam angle BA1 and its angle RA1 once refracted (bent) by RWP1 is greater than the variation between the sectional beam angle BA2 and its angle RA2 once refracted (bent) by RWP1. Further, the angle A3 of RWP3 is in the reverse direction of both A2 of RWP2 and A3 of RWP3 causing the cross-sectional difference between BA3 and its angle once refracted RA3 to be greater than the difference between BA1 and RA1, and BA3 and RA3. This is further elaborated on in FIG. 1 with the explanation of the function of the wedge prism (ring). The radial collimator RC of FIG. 1 can also be used in substitution of CRC in FIG. 3 with WPR of FIG. 4.

Figure 5:
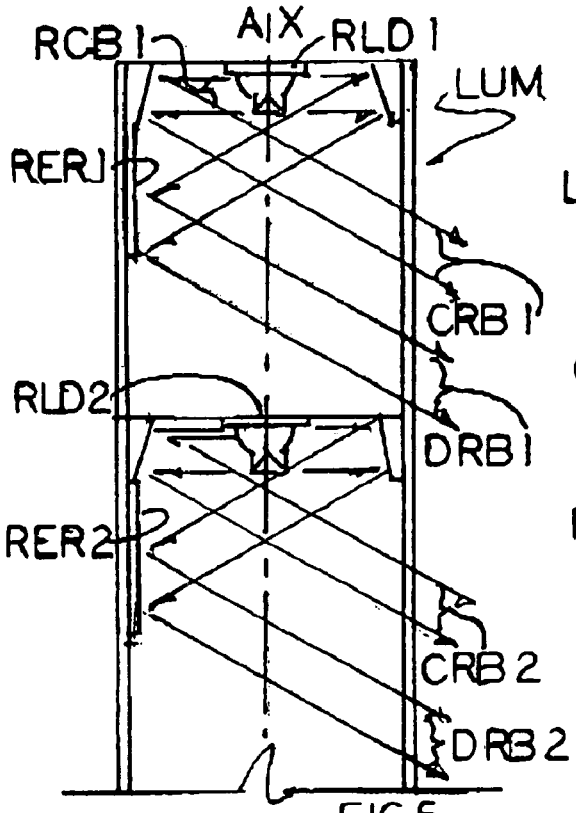
FIG. 5 is a cross-sectional diagram similar to FIG. 1*a* further comprising a second ring reflector.

FIG. 5 is a cross-sectional diagram of two RLD modules, RLD1 and RLD2, similar in function to those of RLD of FIGS. 1, 1A, or FIG. 1B or FIG. 1C with the addition of retro reflector rings RER1 and RER2 respectively. RER1 and RER2 (which at least partially surround AX) reflect rays CRB1 and CRB2 as rays DRB1 and DRB2 respectively, which project in the same radial direction as CRB1 and CRB2 (that are not reflected by RER1 and RER2) respectively. Although 2 RCD modules are shown, any number of modules can be combined.

Figure 6:
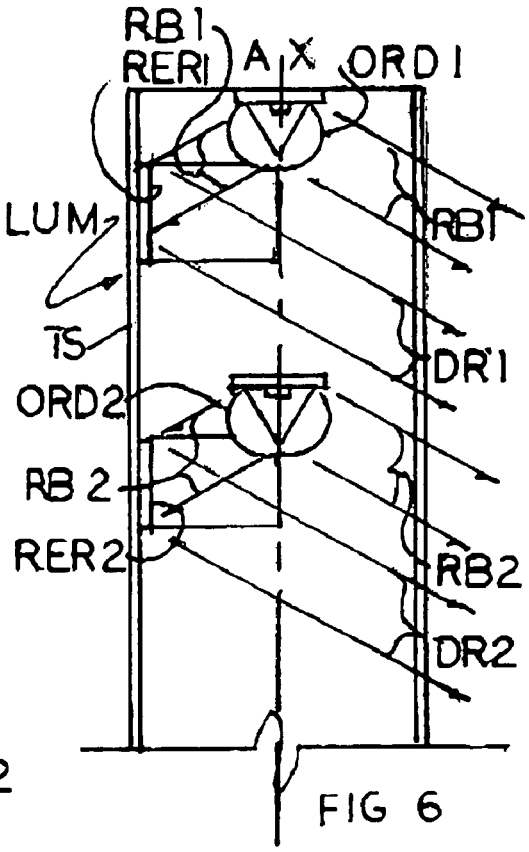
FIG. 6 is a cross-sectional view of an oil axis radial beam projector.

FIG. 6 is a cross-sectional diagram of an off axis radial beam projector comprising two ORD modules ORD1 AND ORD2 projecting canted radial beams RB1 and RB2 respectively. Reflector rings RER1 and RER2 which partially surround AX, reflect a portion of ORD1 and ORD2 as partial canted radial beams DR1 and DR2 respectively in the same radial direction as RB1 and RB2 respectively.

Figure 7:
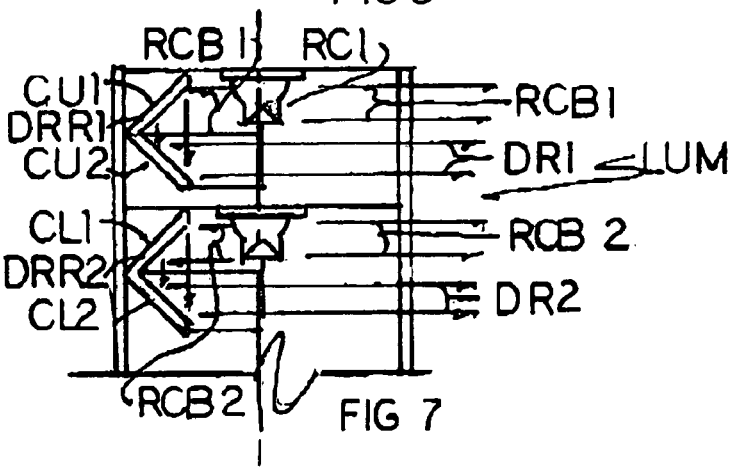
FIG. 7 is a cross sectional diagram similar to FIG. 1*a* wherein the ring reflector is comprised of two conical segments.

FIG. 7 is a cross-sectional diagram of two modules RC1 and RC2, each containing a quasi-point light source and a radially collimating ring optic similar to RC of FIG. 1, with the addition of compound reflectors DRR1 and DRR2 respectively. DRR2 and DRR2 are comprised of two truncated conical reflectors CU1 and CU2, and CL1 and CL2, joined at the large diameters so that rays RCB1 are reflected by CU1 onto CU2 and exit as rays DR1, which are projected in the same radial direction as rays CB1. Similarly rays RCB2 are reflected by CL1 onto CL2, which are reflected by CL3 as rays DR2.

Figure 8:
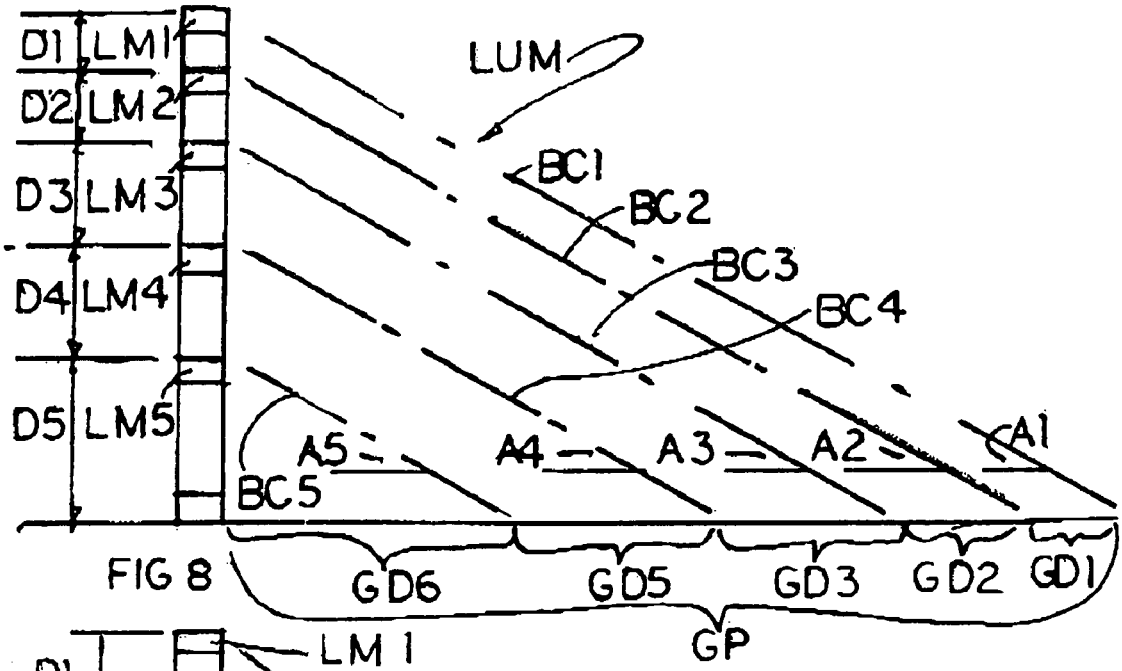
FIG. 8 is an elevation view diagram of a luminaire comprised of radial light projecting modules located at varying distances along the luminaire.

FIG. 8 is an elevation view diagram of a luminaire LUM comprised of radial light distribution modules LM1, LM2, LLM3 and LM5, mounted within tubular support TS. All the LM modules can be of a single type as any of the those shown in FIG. 1, 1A, 1B, 1C, 2, 2A, 2B, 3, 3A, 4, 4A, 5, 6, or 7, or be a combination of any of the radial light distribution modules shown; however, FIG. 8 is primarily illustrating the use of multiples of a single type of radial light distribution module. The distance D1, D2, D3, D4, and D5 between the modules increases between each of the modules as the distance of the modules decreases from the ground (surface) plane GP. Each module shown projects a radial beam having a beam center BC1, BC2, BC3, BC4, and BC5 respectively each at substantially the same angle A1, A2, A3, A4, and A5 to GP. Therefore, the distances between the modules D1, D2, D3, D4, and D5 are substantially the same ratios to the distances at GD1, GD2, GD3, GD4, and GD5 between the beam centers that strike GP. Referencing the reverse square law, it becomes necessary to provide an increasingly higher concentration of light further from the source, in order to maintain uniform brightness as the distance from the source increases. One way of achieving uniform brightness is to increase the density of projected beams as the distance from the source increases. This is clearly illustrated in the system described in this figure (8) and is further illustrated in FIGS. 1A and 1B.

Figure 9:
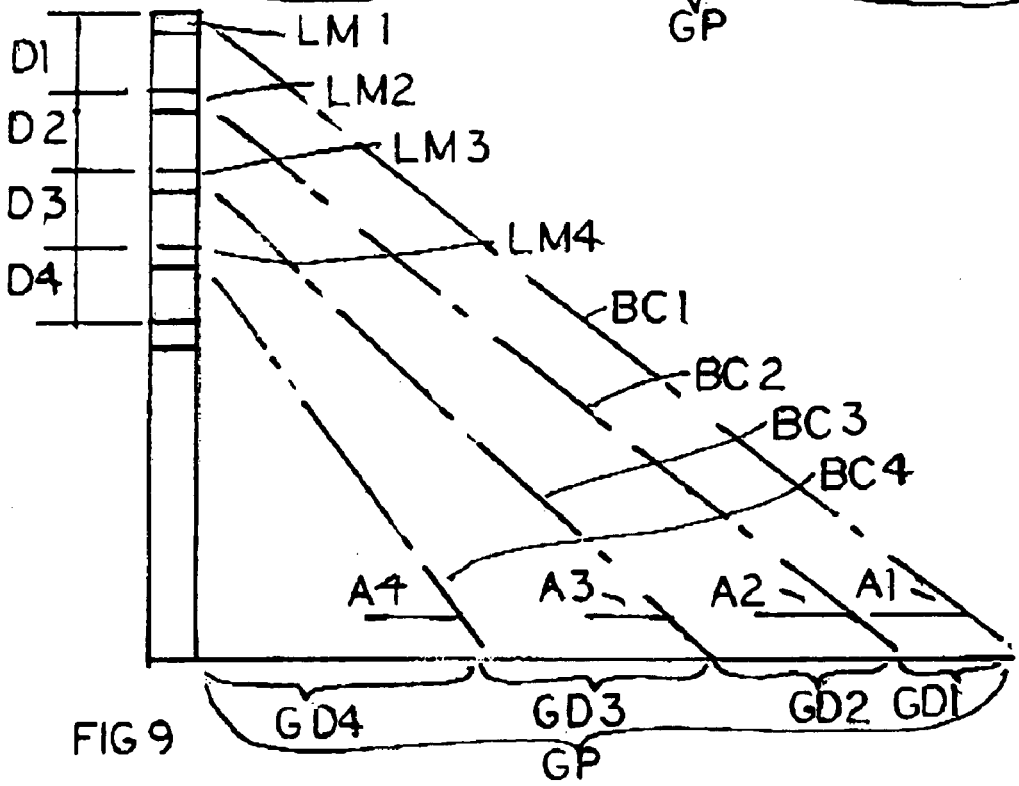
FIG. 9 is an elevation view diagram of a luminaire similar to that in FIG. 8 wherein the radial light projecting modules are substantially spaced equally.

FIG. 9 is an elevation view of a luminaire LUM mounted on a ground plane GP comprised of a grouping of radial light distribution modules LM1, LM2, LM3, and LM4 (mounted within TS). The distance D1, D2, D3, and D4 between and relative to the modules is substantially equal. Each LM module projects a radial beam (their respective centers are represented by BC1, BC2, BC3, and BC4) and are all projected at different angles (A1, A2, A3, and A4) to GP, the angles becoming progressively steeper to the ground plane from A1 through A4. One way this can be achieved by using the optical system described in FIGS. 1C, 1D, 2C and 4A. Also differing reflective surfaces as represented by CRS1, CRS2, and CRS3 of FIG. 1B can be incorporated to change the beam spread of any or all the LM modules illustrated in FIG. 9 (or in FIG. 8). Generally, the LM module that is closest to the ground plane (LM4) would contain the CR5 surface that creates the widest beam divergence. Conversely, the LM module that is furthest from GP (LM1) would contain the CRS surface that creates the narrowest beam divergence. The substantially concentric areas of GP that receive projected light from LM1, LM3, LM3, and LM4 are GD1, GD2, GD3, and GD4 which become progressively wider as they get closer to the luminaire LUM.

Figure 10:
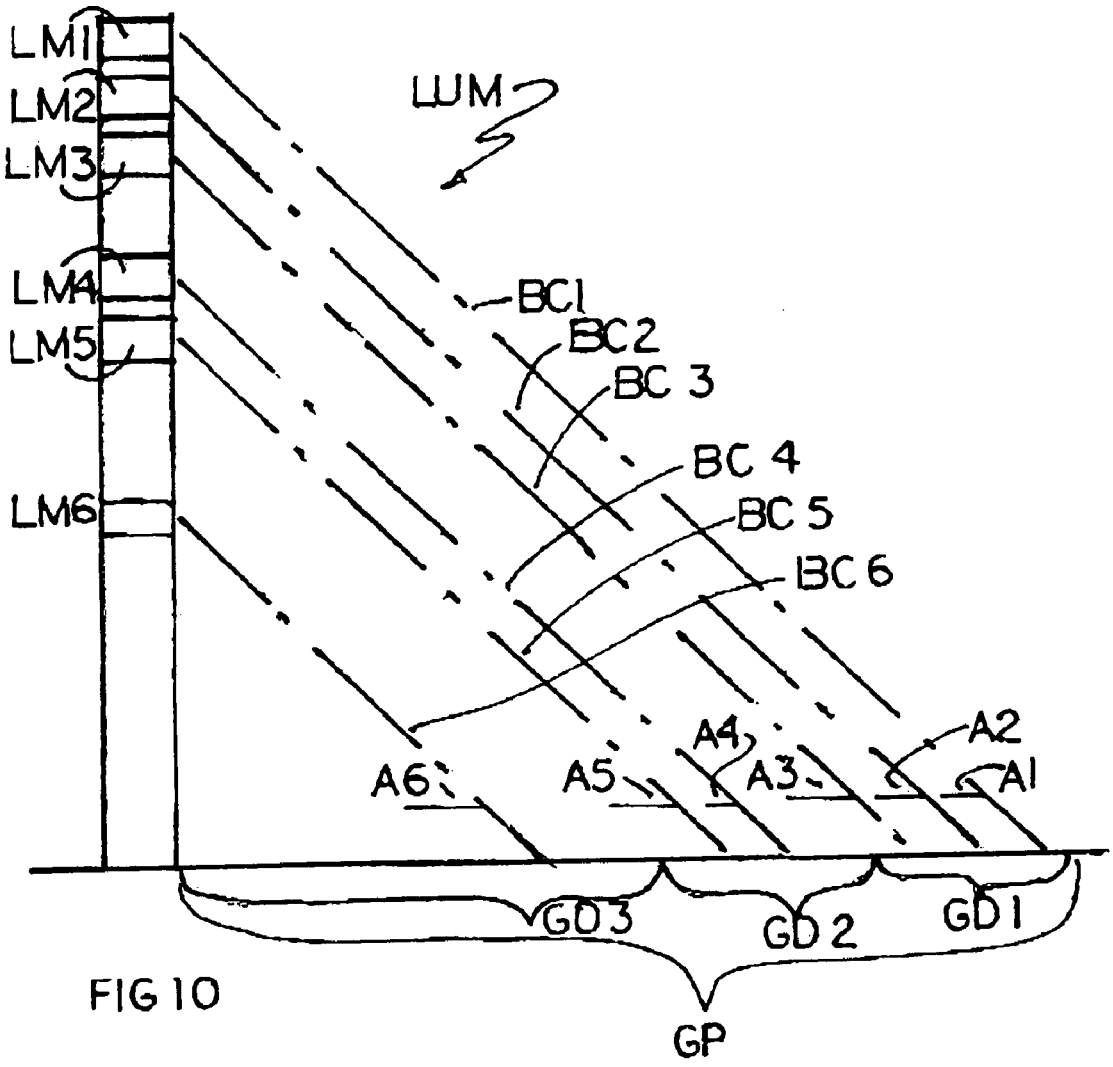
FIG. 10 is an elevation view diagram of a luminaire similar to that in FIG. 8 wherein each module projects a radial beam, each beam being projected a substantially the same angle.

FIG. 10 is an elevation view of a luminaire LUM comprised of LM modules LM1, LM2, LM3, LM4, LM5, and LM6 projecting radial beams (represented by beam centers BC1, BC2, BC3, BC4, BC5, and BC6) onto GP. In order to achieve relatively even brightness throughout BP, LM1, LM2, and LM3 are stacked closely together, projecting beams A4 and A5 which are wider than LM1, LM2, and LM3. LM6 projects the widest beam, A6, onto GD3. BC1, BC2, BC3, BC4, BC5 and BC6 are all projected at equal angles represented by A, A1, A2, A3, A4, and A5. Although FIGS. 8, 9, and 10 illustrate LUMs mounted to GP, LUMs can be inverted and mounted to ceilings or be mounted to walls to spread indirect illumination.

Figure 11:
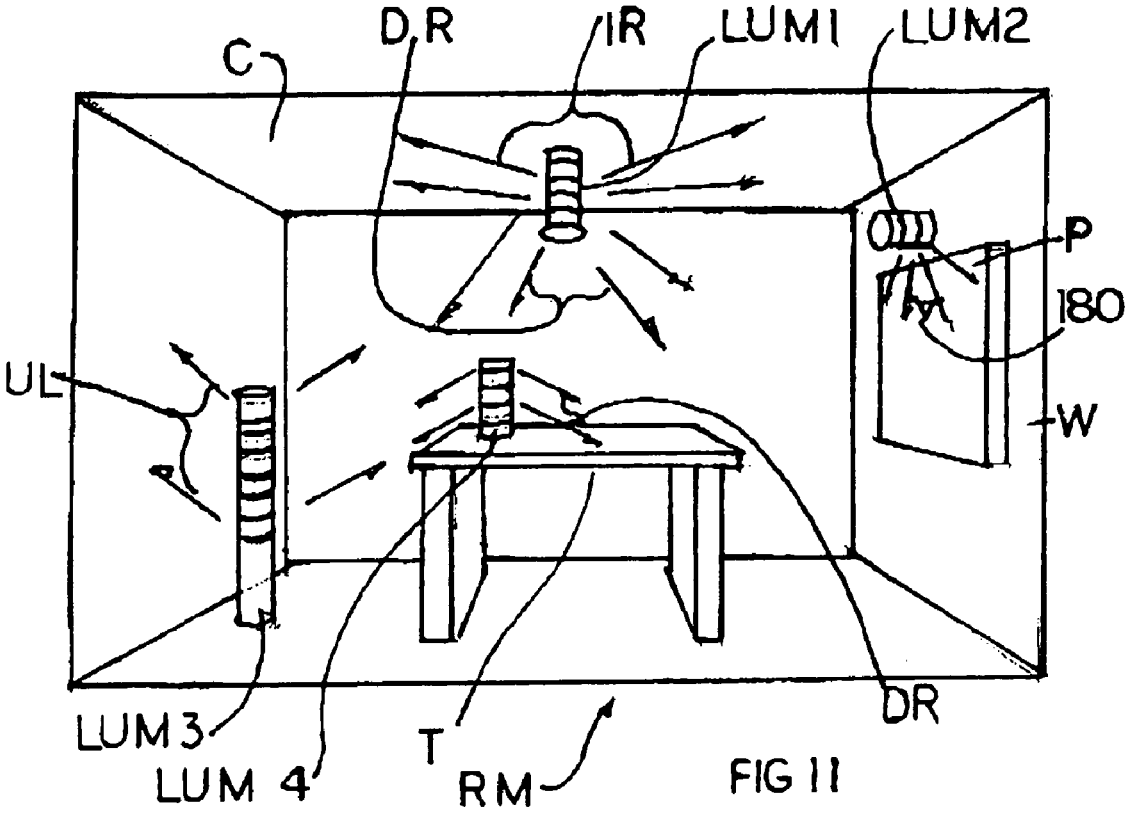
FIG. 11 is a perspective view of a room containing radially projecting luminaries positioned and located to illuminate various areas of the room.

FIG. 11 Is a perspective view of a room RM containing four LUM luminaries. Each luminaire is comprised of one or several types of radial beam modules as described in FIGS. 1 through 7.

LUM1 is a ceiling-mounted IR luminaire having an up-light indirect distribution as illustrated and described in FIGS. 8, 9, and 10, and a down-light distribution DR provided by inverted LUM modules as those LUMs that provide the up-light distribution.

LUM2 is a luminaire mounted substantially perpendicular to wall W providing substantially 180° downward illumination on picture P. Lum2 is comprised of an optical system similar to that of either or FIGS. 5, 6, and 7.

LUM3 is a floor lamp providing up-light UL.

LUM4 is a table T lamp providing down-light to T.

FIG. 11 illustrates a limited number of total uses for the optical configurations in this Patent Application. Others include outdoor poles, bollards, path lights, wall packs, etc.

Figure 12:
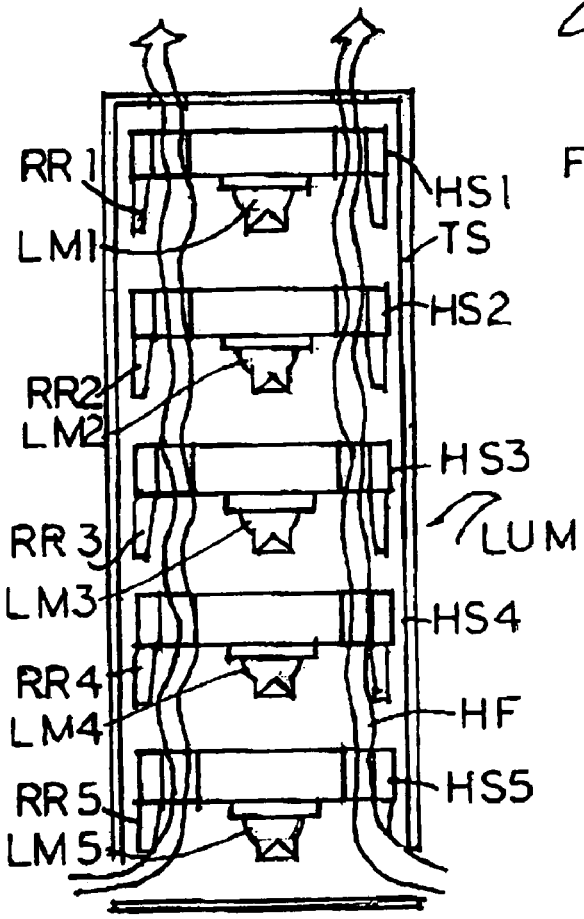
FIG. 12 is a cross-sectional view of a luminaire illustrating air flow through a stack of combined multiple quasi point light sources and the heat sinks to which they are attached.

FIG. 12 is a sectional view of a luminaire LUM containing stacked groups of any combination of LMs or ORDs as described in FIGS. 1 through 7 or any stacked series of quasi-point sources such as LEDs. Module LM is mounted to a heat sink HS11, HS2, HS3, HS4, and HS5. In the case of LEDs, this is necessary to maintain lumen output and LED light. Each heat sink is constructed in such a way as to allow air to pass through from one to another represented by HF rising through HS5 to and through HS1. LUM of FIG. 12 is also comprised of tubular form TS which substantially encompasses the stack of modules LM1 through LM5 and their associated heat sinks HS1 through HS5. TS acts to provide a chimney effect for HF rising through LUM.

Figure 12A:
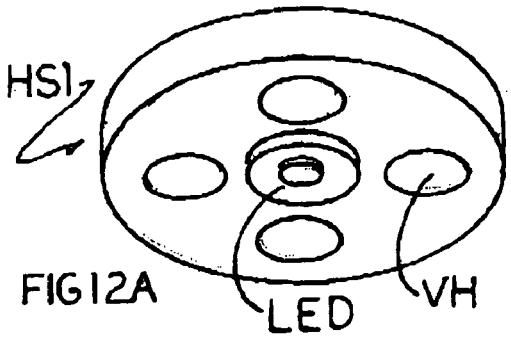
FIG. 12A illustrates a type of heat sink that be used in FIG. 12.

FIG. 12A is a three-dimensional diagram of one type of heat sink that may be utilized as an example of the luminaire shown in FIG. 12. The quasi-point source LED is mounted to HS1. Surrounding the mount of LED on HS1 are vent holes VH in HS1, allowing air to rise through.

Figure 12B:
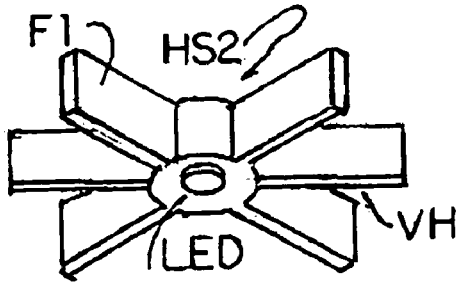
FIG. 12B illustrates a variation of the heat sink described in FIG. 12A.

FIG. 12B is a three-dimensional diagram of another type of heat sink HS2. HS2 contains a mount for an LED and radiating fins that allow air to pass through the space between the fins VS.

Figure 12C:
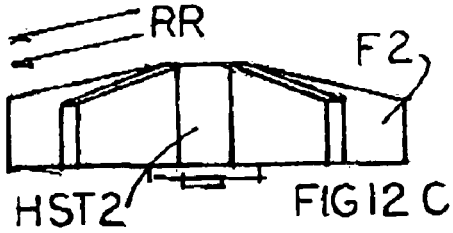
FIG. 12C illustrates still another variation to the heat sink described in FIG. 12A.

FIG. 12C is a side view of a heat sink HST2 which is similar to HS2 of FIG. 12B, differing in that the fins F2 are tapered so as not to obstruct canted radial beam RR projected by an LM or ORD (not shown).

Figure 12D:
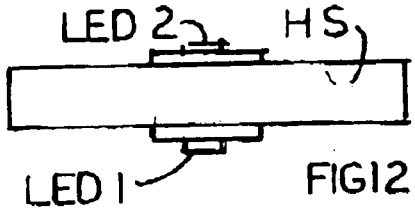
FIG. 12D illustrates a variation to the heat sink shown in FIG. 12*b*.

FIG. 12D is a side view diagram of two quasi-point light sources LED1 and LED2 mounted back to back on the same flat heat sink HS.

Figure 12E:
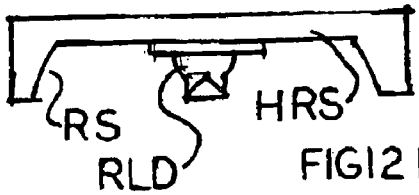
FIG. 12E illustrates a type of heat sink that can be used in 12 wherein the heat sink comprises a reflector portion.

FIG. 12E is a section view diagram of a heat sink HSR on which is mounted a quasi-point light source RLD that can or can not be surrounded by a collimating ring, further surrounded by a reflective surface RS.

Figure 13:
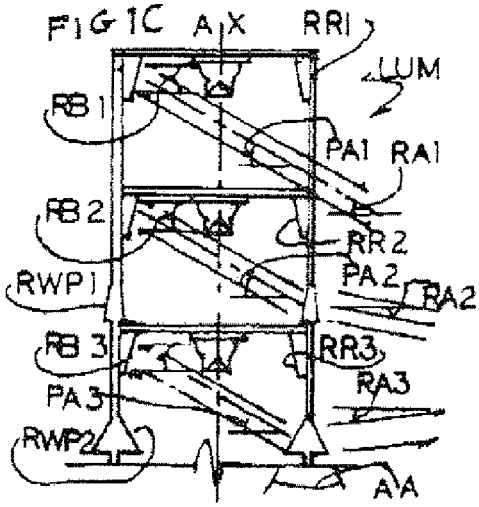
FIG. 13 is a cross-sectional view of a luminaire having three quasi point light sources.
Figure 13:
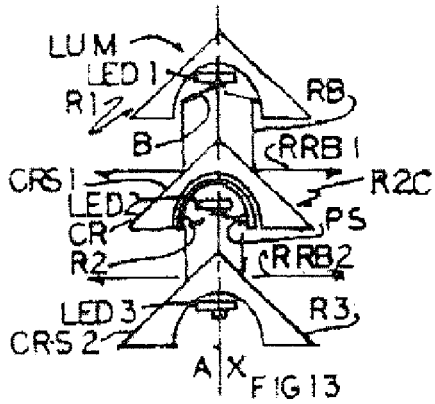

FIG. 13 is a cross-sectional diagram of a luminaire comprised of 3 quasi-point light sources LED1, LED2, and LED3, each at least partially surrounded by a reflector system R1, R2C, and R3 respectively. The function of reflective surface PS1 of R1 (which may be parabolic, ellipsoidal, or spherical) is to collect rays B emanating from LED1 and redirect them as RB onto the reflective surface CRS1 of substantially conical reflector CR which in turn reflects RB as radial beam RRB1. The function of reflectors R2 to R3 is similar to that described between R2 and R1. R2C is comprised of two elements, a light collimating element R2 similar in description and function to R1, and a conical reflecting element CR (both on the same optical axis). R3 is a single element combining a collecting surface RL3 and a substantially conical surface CRS2. CRS and or CRS2 can be straight in section (as shown) or convex or concave.

It is to be understood that the above-described embodiments are simply illustrative of the principles of the invention. Various and other modifications and changes may be made by those skilled in the art which will embody the principles of the invention and fall within the spirit and scope thereof.

What is claimed is:

1. A luminaire for providing broad uniform surface illumination and sharp cutoff comprising: a stack of at least two separate light projecting modules sharing a common optical axis, each said module projecting an off-axis radial beam onto a surface; each said module including a quasi point light source which is an LED mounted to a heat sink, each said LED partially surrounded by a radially collimating optic gathering and projecting light from said LED and projecting it as a radial beam onto a ring-shaped optic disposed outwardly from said collimating optic so as to redirect the light rays of said radial beam away from said luminaire onto said surface, wherein said ring-shaped optic is a ring-shaped reflector and each ring-shaped reflector reflecting a canted radial beam through said optical axis, and, other than the end-most ring-shaped optic, at a point between each said quasi point light source; the type and configuration of said radially collimating optic and said ring optic in relationship to each other within any two of said modules is such that the beam configuration of said canted radial beam projected by each of said modules is different from the other module.

2. A luminaire as in claim 1 wherein said beam configuration of said canted radial beams differ in cross-sectional beam divergence and concentration of light within said beam.

3. A luminaire as in claim 2 wherein the ring reflector that at least partially surrounds said optical axis reflects light through the optical axis as a canted radial beam onto a second reflector ring which in turn reflects a canted radial beam onto and back through and away from the optical axis.

4. A luminaire as in claim 2 wherein each of the two of the ring reflectors reflect their respective canted beams at different angles in relationship to said optical axis.

5. A luminaire as in claim 2 wherein the cross-sectional profile of said ring reflector is flat or curved, being spherical, ellipsoidal or parabolic.

6. A luminaire as in claim 2 wherein said reflective ring is comprised of two substantially cortical reflector segments arranged so that the larger diameters of each ring segment face each other, the first ring segment gathering and redirecting at least a portion of the radially collimated beam substantially parallel to said optical axis onto said second reflector segment which in turn reflects said beam portion toward and through said optical axis.

7. A luminaire as in claim 1 wherein said beam configuration of said canted radial beams differ in the angular directionality of the beam toward the surface to be illuminated.

8. A luminaire as in claim 1 wherein at least one of said radially collimating optic is a radially collimating lens projecting a radial beam away from and perpendicular to said optical axis, said ring-shaped optic being a reflective ring, the surface of which is disposed at an angle to reflect and direct said radial beam as a canted radial beam through and away from said optical axis and from said luminaire.

9. A luminaire as in claim 8 wherein one surface of one reflecting ring is different than the reflecting surface of another reflecting surface resulting in their respective reflective canted radial beams having different cross-sectional beam patterns.

10. A luminaire as in claim 8 wherein, when there are more than two of said light projecting modules, the spacing between any two of the modules differs from the spacing between any other two modules.

11. A luminaire as in claim 1 wherein at least one said module includes a reflector ring, and at least one said module includes a refracting ring.

12. A luminaire as in claim 1 wherein the spacing between any of two modules is different from any other two modules within a single luminaire creating a change in the beam patterns between said pairs of modules.

13. A luminaire as in claim 1 wherein said heat sink for at least one of the LEDs that is located between two LEDs is at least partially shaped as a cone and disposed so as to not obscure either of the canted radial beams.

14. A luminaire as in claim 1 wherein each said quasi point light source is thermally attached to a heat sink, each said heat sink having strategically located openings to allow air to flow through from one heat sink to another.

15. A luminaire as in claim 1 wherein the modules are located and supported within a tube at least portions of which are optically transmissive.

16. A luminaire as in claim 1 wherein the reflector ring partially surrounds the optical axis, each reflecting only a portion of the canted radial beam back through the optical axis in the same radial direction as the portion of the radial beam projected by said off axis collimating ring lens that has not been reflected by the ring reflector.

17. A luminaire as in claim 1 is designed to function as an indoor or outdoor fixture being a bollard, path light or other post top luminaries.

18. A luminaire as in claim 1 is designed to function as an indoor or outdoor fixture being a pendant, sconce, floor or table lamp.

19. A luminaire for providing broad uniform illumination as in claim 1 wherein at least one radially collimating optic is an off axis collimating ring lens at least partially surrounding at least one quasi point light source, and projecting a canted radial beam away from the optical axis; and said ring optics is a refracting ring at least partially surrounding the optical axis and positioned to refract said canted radial beam at an angle differing from said canted radial beam.

20. A luminaire as in claim 19 wherein said refracting ring is a wedge prism in cross-section.

21. A luminaire for providing broad uniform surface illumination and sharp cutoff comprising; at least one quasi point light source which is an LED located on an optical axis; at least one collimating ring lens at least partially surrounding said quasi point light source, said collimating ring projecting a radial collimated beam substantially axially perpendicular to said optical axis; and at least one reflective ring at least partially surrounding said collimating ring lens, the reflective surface of which is disposed at an angle so as to reflect and direct said radially collimated beam as a canted radial beam through said optical axis, wherein there are at least two quasi point light sources, all being on the same optical axis, and at least two radially collimating ring lenses, each at least partially surrounding said quasi point light sources, at least two ring reflectors, each at least partially surrounding a collimating ring lens, each reflector ring reflector other than the lowest ring reflector reflecting a canted radial beam through said optical axis at a point between each said quasi point light source.

22. A luminaire for providing broad uniform surface illumination and sharp cutoff comprising: a stack of at least two separate light projecting modules sharing a common optical axis, each said module projecting an off-axis radial beam onto a surface; each said module including a quasi point light source which is an LED mounted to a heat sink, each said LED partially surrounded by a radially collimating optic gathering and projecting light from said LED and projecting it as a radial beam onto a ring-shaped optic disposed outwardly from said collimating optic so as to redirect the light rays of said radial beam away from said luminaire onto said surface; the type and configuration of said radially collimating optic and said ring optic in relationship to each other within any two of said modules is such that the beam configuration of said canted radial beam projected by each of said modules is different from the other module; the radially collimating optic within at least one said module is an off axis collimating ring lens at least partially surrounding at least one quasi point light source, and projecting a canted radial beam away from the optical axis; and said ring optic is a ring reflector at least partially surrounding the optical axis and positioned to reflect the canted radial beam toward and through the optical axis.

* * * * *